US005755945A

United States Patent [19]

Kristiansen

[11] Patent Number: 5,755,945

[45] Date of Patent: May 26, 1998

[54] METHOD FOR DEHYDRATING CAPILLARY MATERIALS

[75] Inventor: Hans Kristiansen, Skui, Norway

[73] Assignee: Electro Pulse Technologies of America, Inc., Greenwich, Conn.

[21] Appl. No.: 728,970

[22] Filed: Oct. 11, 1996

[51] Int. Cl.[6] ..... B01D 13/02

[52] U.S. Cl. ..... 204/515

[58] Field of Search ..... 204/515, 450

[56] References Cited

U.S. PATENT DOCUMENTS

| | | | |
|---|---|---|---|
| 4,600,486 | 7/1986 | Oppitz | 204/182.3 |
| 5,015,351 | 5/1991 | Miller | 204/182.2 |
| 5,368,709 | 11/1994 | Utklev | 204/182.2 |

FOREIGN PATENT DOCUMENTS

| | | |
|---|---|---|
| 140265 | 2/1982 | Poland . |
| 81067852 | 11/1981 | Sweden . |
| 8601888-4 | 4/1986 | Sweden . |
| 450264 | 6/1987 | Sweden . |

*Primary Examiner*—Kathryn L. Gorgos
*Assistant Examiner*—Kishor Mayckar
*Attorney, Agent, or Firm*—Lathrop & Clark

[57] ABSTRACT

A method for dehydrating capillary materials such as moist walls and/or floors of a building structure of masonry or concrete through the principle of electro-osmosis by applying pulsating DC voltage of a specific pulse pattern to primary electrode means embedded in said structure, said primary electrode means (4) forming anode means, and secondary electrode means (5) embedded in the ground outside the structure and forming cathode means to be interactive with said anode means, said pulsating voltage having a pulse pattern with a total pulse period T, comprised of a positive pulse of duration T+, a negative pulse of duration T−, and a neutral period or pause of duration Tp, wherein:

$$0.8T<T+\leqq 0.98T;$$

$$0.0T<T-\leqq 0.05T;$$

$$0.02T<Tp\leqq 0.15T;$$

and $$3 \text{ seconds}<T\leqq 60 \text{ seconds}.$$

Suitably, T+=0.95 T; T−=0.01 T; and Tp=0.04 T.

9 Claims, 6 Drawing Sheets

FIG. 1
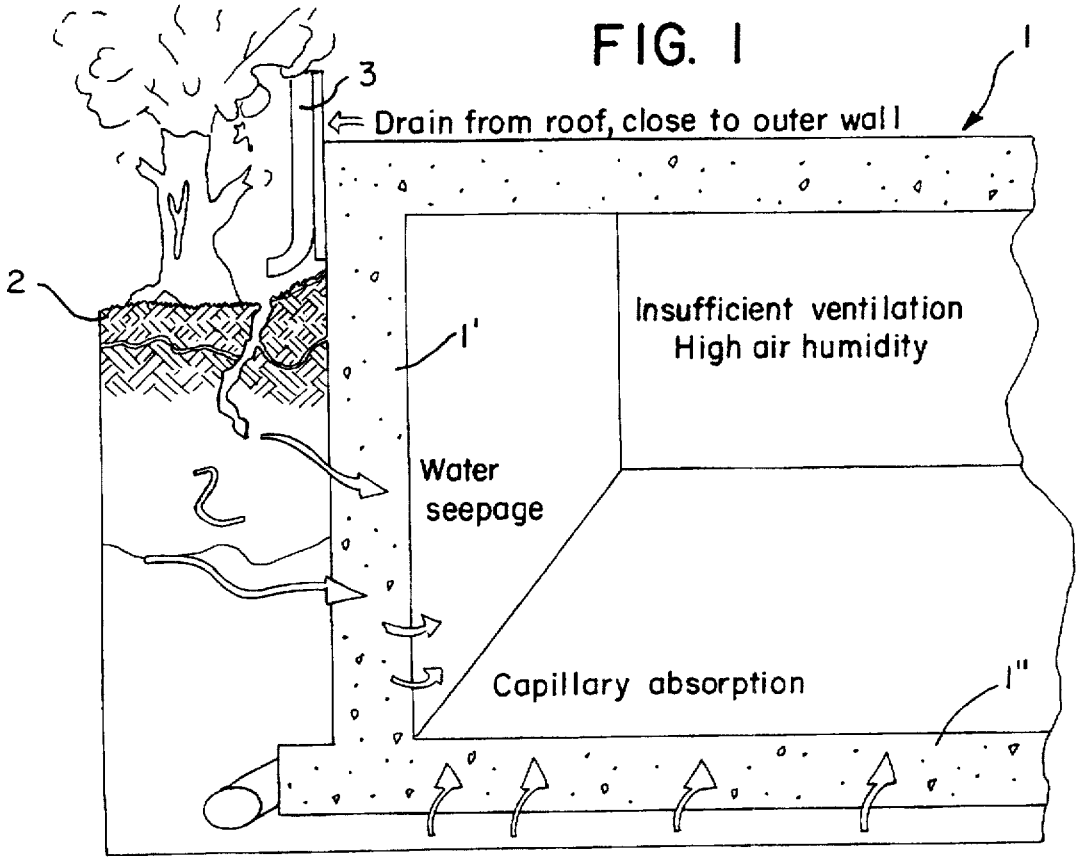
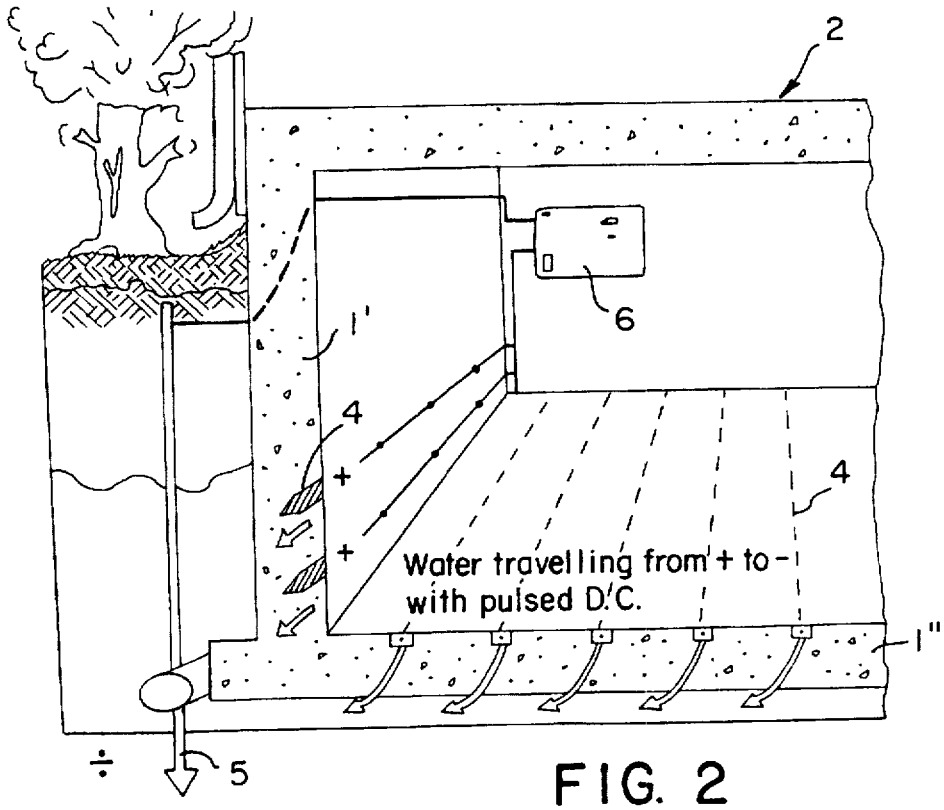
FIG. 2

METHOD FOR DEHYDRATING CAPILLARY MATERIALS

FIELD OF THE INVENTION

The present invention relates to a method for dehydrating capillary materials such as moist walls and/or floors of a building structure of masonry or concrete through the principle of electro-osmosis by applying pulsating DC voltage of a specific pulse pattern to primary electrode means embedded in said structure, said primary electrode means forming anode means, and secondary electrode means embedded in the ground outside the structure and forming cathode means to be interactive with anode means, said pulsating voltage having a pulse pattern with a total pulse period T, comprised of a positive pulse of duration T+, a negative pulse of duration T−, and a neutral period or pause of duration Tp.

BACKGROUND OF THE INVENTION

Problems relating to moisture in building structures, in particular building structures located under ground such as basements, are more than often occurring. Present days requirements to minimum building erection time very easily results in a reduced emphasis on the requirements relating to concrete as regards sufficient drying time, something which in due course easily leads to moisture problems in the building structure. The reason is that concrete is of such composition that conventional drying methods, e.g. by using dehumidifiers in combination with heating will take too much time.

Over many years research has been carried out on methods for efficiently dehydrating capillary materials and in particular structures of concrete or masonry. The disadvantages of most of these methods are that they require much energy in addition to the time aspect. The principle of electro-osmosis was discovered by professor Reuss already in 1807. Electro-osmosis is based on the following fundamentals. Assume that a material, spontaneously or in an artificial way has been subjected to a voltage potential difference between two points thereof. Further, assume that the capillary structure of the material has been saturated by water. The capillary walls will more than often assume a negative potential. This causes positive ions in the water to be located around the capillary walls. This phenomenon is called the electrical double layer. The positive ions will now move towards regions having a lower potential. Due to the positive ions being hydrated, each ion will carry a small amount of water, and thereby a water flow is created.

Over the years electro-osmosis has been attempted to be put into commercial activity, however with not too much success with regard to dehydration of building structures. In some European countries there have been used so-called passive, electro-osmosis systems. This means that there have been used the natural potential differences which will be created between a moist structure and the surroundings. The effects of this type of installation has been rather non-convincing.

In all types of electro-osmosis related systems up to the 1980'ies, there has been used direct current or conventional alternating current (50 Hz). This means that it is only possible to carry water between anode and cathode over a shorter period, because the forces after some while will reverse, such that the electrolyte (water) is transported back to its origin.

Thus, the situation has been related to have a system capable of functioning over an extended period of time, without the so-called "zeta potential" being reversed, (implying that the water returns back to the capillary material).

Attempts were therefore made to develop apparatus emitting pulsating direct current. Such systems are e.g. known from the publicly available U.S. Pat. Nos. 5,368,709, 4,600,486 and 5,015,351, Swedish patent applications 8106785-2 and 8601888-4 (T. Eliassen), application 8202570-1 (A. Basinsky), Swedish patent 450264, and Polish patent 140265 (Basinsky et al). The problems related to the prior art systems have been the durability of the electrodes on the anode-side of the system as the anodes are easily corroded due to a reduction-oxidation. In addition, the problems have been related to balancing with regard to pulses (the relationship between the positive and negative energy in voltage-seconds, also denoted as magnetic flux) in such way that a maximum water flow out of the building structure is obtained, without having a further moisturising of the structure at a later time. In the prior art it has therefore been attempted over many years to develop systems with pulsating DC voltages in such a way that the electro-osmotic forces after a period of time do not reverse to cause the transport of liquid to go the opposite way of that desired.

SUMMARY OF THE INVENTION

According to the present inventive method, it has been discovered that the pulse pattern structure is very important in order to obtain optimum dehydrating results. In order to optimise the forces created in the capillary structure of the material, it is important to be able to have a pulse pattern which can be varied, dependent on the chemical composition of the electrolyte and the electric voltage applied to the material, in addition to the capillary size. Contrary to conventional methods, it has, according to the present invention been discovered that the pulse pattern should be ruled by the following conditions $$0.8T<T+\leqq 0.98T;$$

$$0.0T<T-\leqq 0.05T;$$

$$0.02T<Tp\leqq 0.15T;$$

and $$3 \text{ seconds}<T\leqq 60 \text{ seconds}.$$

Thus, by electing T+ and T−, the neutral period or pause of duration Tp will automatically obtain its value. However, Tp should not be less than 2% of the total pulse period. Thus, in a particular test installation, it has been shown that particular good results are obtained when T+=0.95 T; T−=0.01 T; and Tp=0.04 T. Contrary to prior art pulse patterns, the present invention provides dehydrating results showing a steady increase in dehydration over time. Most importantly, it has been discovered by the inventor that by having the positive pulse of a duration T+ greater than 80% of the total pulse period T, there is an distinct increase in dehydrating results.

Suitably the pulse pattern of duration T should be reiterated for a time period of at least 3 days, suitably at least 15 days.

The positive pulse has DC voltage amplitude elected from the range +12 volts to +250 volts, and the negative pulse should have DC voltage amplitude elected from the range −12 volts to −250 volts. Although in a preferred embodiment of the invention the pulse pattern has positive and negative pulses of substantially equal numerical DC voltage values, it nevertheless lies within the scope of the present invention to use pulse patterns having positive and negative pulses of unequal numerical DC voltage values. This implies that the positive pulse could e.g. have voltage rating of +50 volts, and with the negative pulse having voltage value of −25 volts. This means that a number of combinations will be possible and also yields that the amplitude pattern is shifted in a parallell fashion in the negative or positive direction relative to the neutral potential. The sum of the positive and negative parts of the pulse pattern over a given time interval will thus express the magnetic flux (Unit Weber), i.e. flow intensity.

The invention is now to be further described with reference to the attached drawing figures.

BRIEF DESCRIPTION OF THE DRAWINGS

FIG. 1 illustrates a conventional environmental situation relating to a building structure of masonry or concrete.

FIG. 2 illustrates a basic apparatus layout for dehydrating the building structure.

DESCRIPTION OF THE PREFERRED EMBODIMENTS

FIG. 1 shows a building structure with the walls 1' and the floor 1" thereof substantially located under the ground 2. Conventionally, there is located a drain pipe 3 running from the roof and close to the outer wall 1'. Water will therefore likely seep into the wall 1' and some capillary absorption will add to the hydration problem which causes a high air humidity in the room under ground. More than often, insufficient ventilation is another problem with building structures of the present type.

Figure 3:
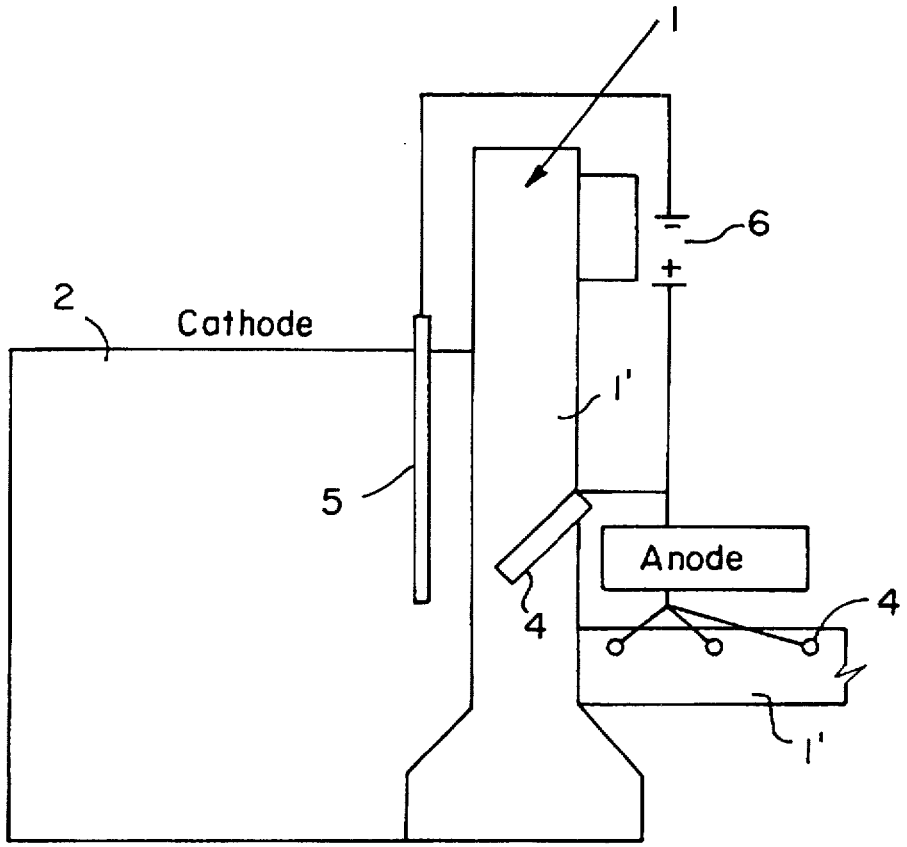
FIG. 3 is a simplified explanation of apparatus structure.

Therefore, the present invention provides a number of anodes 4 provided in the walls and/or in the floor of the underground building structure. A common cathode means 5 is embedded in the ground, as e.g. indicated on FIG. 2. Thus, when a power control unit generally denoted by reference numeral 6 is able to supply a DC voltage pattern to the anodes 4 embedded in the building structure and the counter electrode 5 forming cathode means, the anodes 4 thus provided with pulsed direct current, water will be travelling from the positive potential to the negative potential. Thus, there will be a water flow out of the building structure 1 and into the ground 2. A more simplified schematic is shown in FIG. 3.

The power control unit 6 includes a power supply unit 7 and an output unit 8. The control unit 6 has a programmable micro-processor 9, program setting panel 10 and a control display 11. The power unit 7 receives AC power via a switch 12 which may be of a heat sensitive type. The supplied voltage is down-converted in a transformer 13 and rectified in a rectifier 14 and suitably stabilised by a capacitor 15 to deliver a DC voltage, suitably of 25 volts DC.

Figure 4:
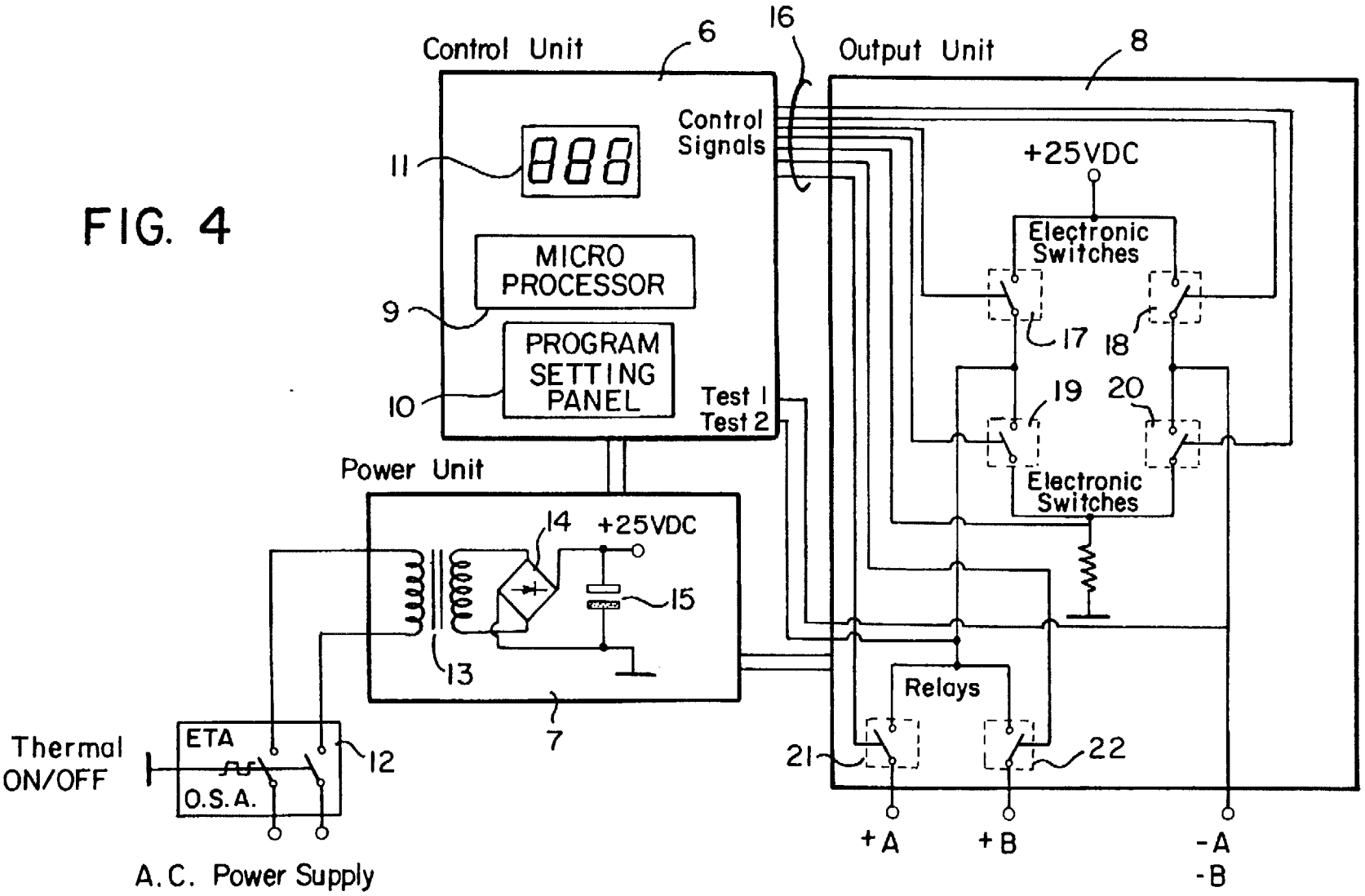
FIG. 4 illustrates a schematic block diagram for a circuitry for carrying out the method according to the invention.

The output unit 8 receives control signals from the control unit 6 via control lines 16 to control the operation of electronic switches 17, 18, 19, and 20, as well as relays 21 and 22 which connect two different sets of anode electrodes 4, denoted in FIG. 4 simply by +A and +B. The common cathode 5 is in FIG. 4 denoted by references −A and −B. Multiple sets A and B of anodes are simply provided in order to take into consideration the overall working capacity of the control apparatus 6 and its associated circuitry. Multiple different sets will provide greater operational safety and also increase dehydration capacity, but the dehydration process may take longer time. However if the working capacity of the apparatus is substantially increased, with associated cost, the dehydration time may be shortened.

Figure 5:
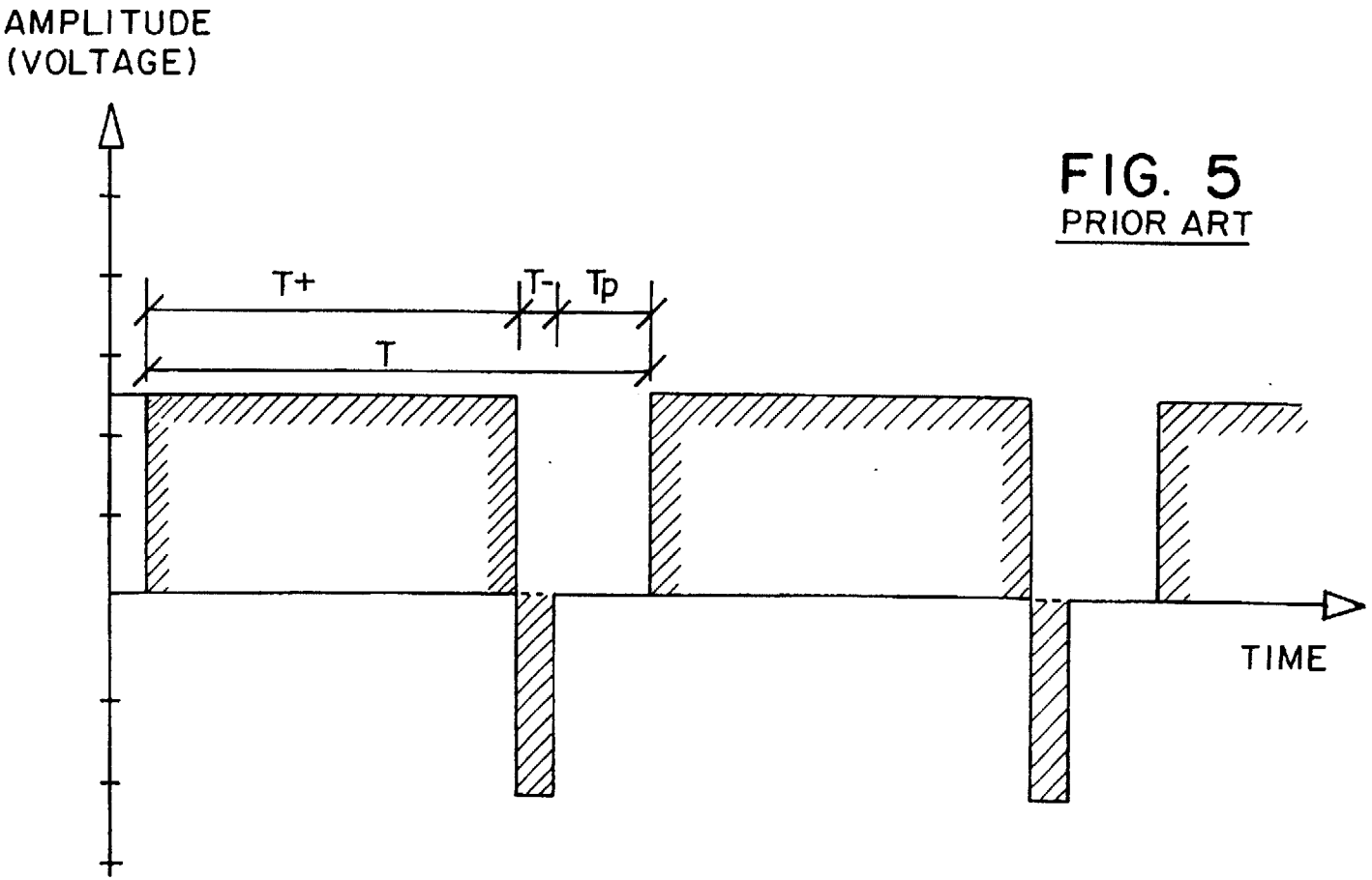
FIG. 5 PRIOR ART
FIG. 5 illustrates a typical pulse pattern according to the prior art.
Figure 6:
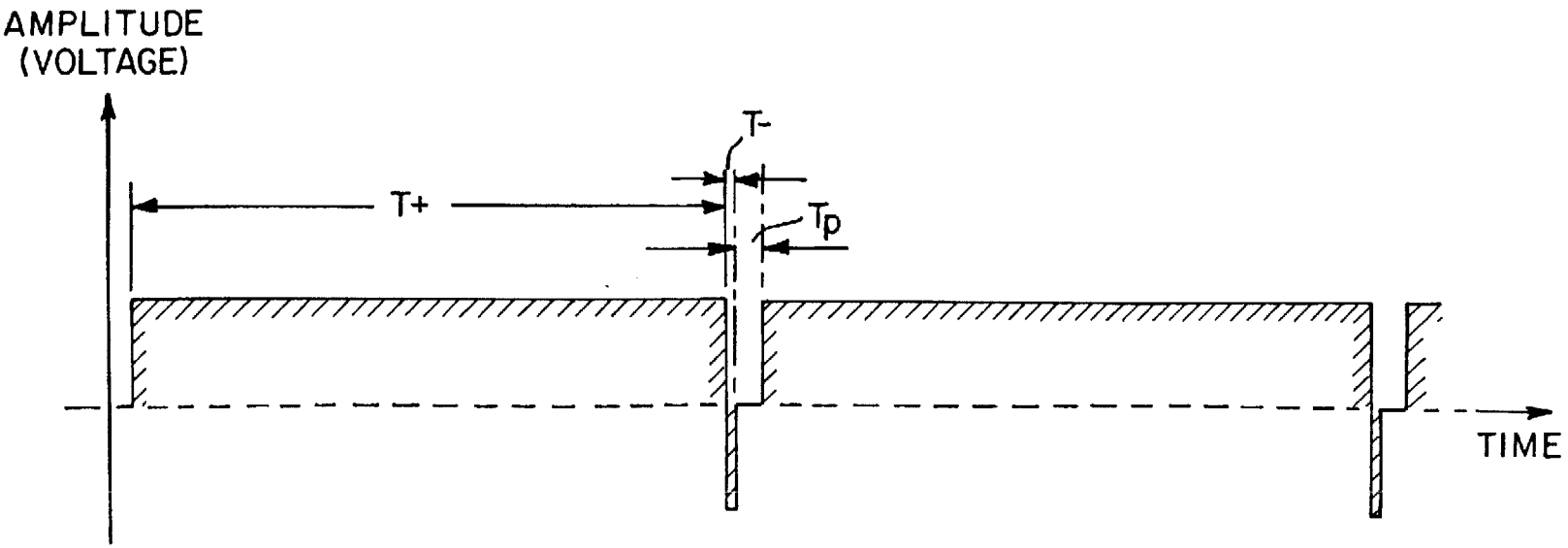
FIG. 6 is a typical pulse pattern according to the present invention.

With a pulse pattern configuration as shown in FIG. 5, it has been shown through laboratory experiments that such pulse pattern and other known conventional pulse patterns will yield a decline and levelling out of dehydration after even such short period as a few days: in the configuration as shown in FIG. 5, T+ is approximately 0.74 T, T− is approximately 0.08 T, and Tp is approximately 0.18 T.

Figure 7:
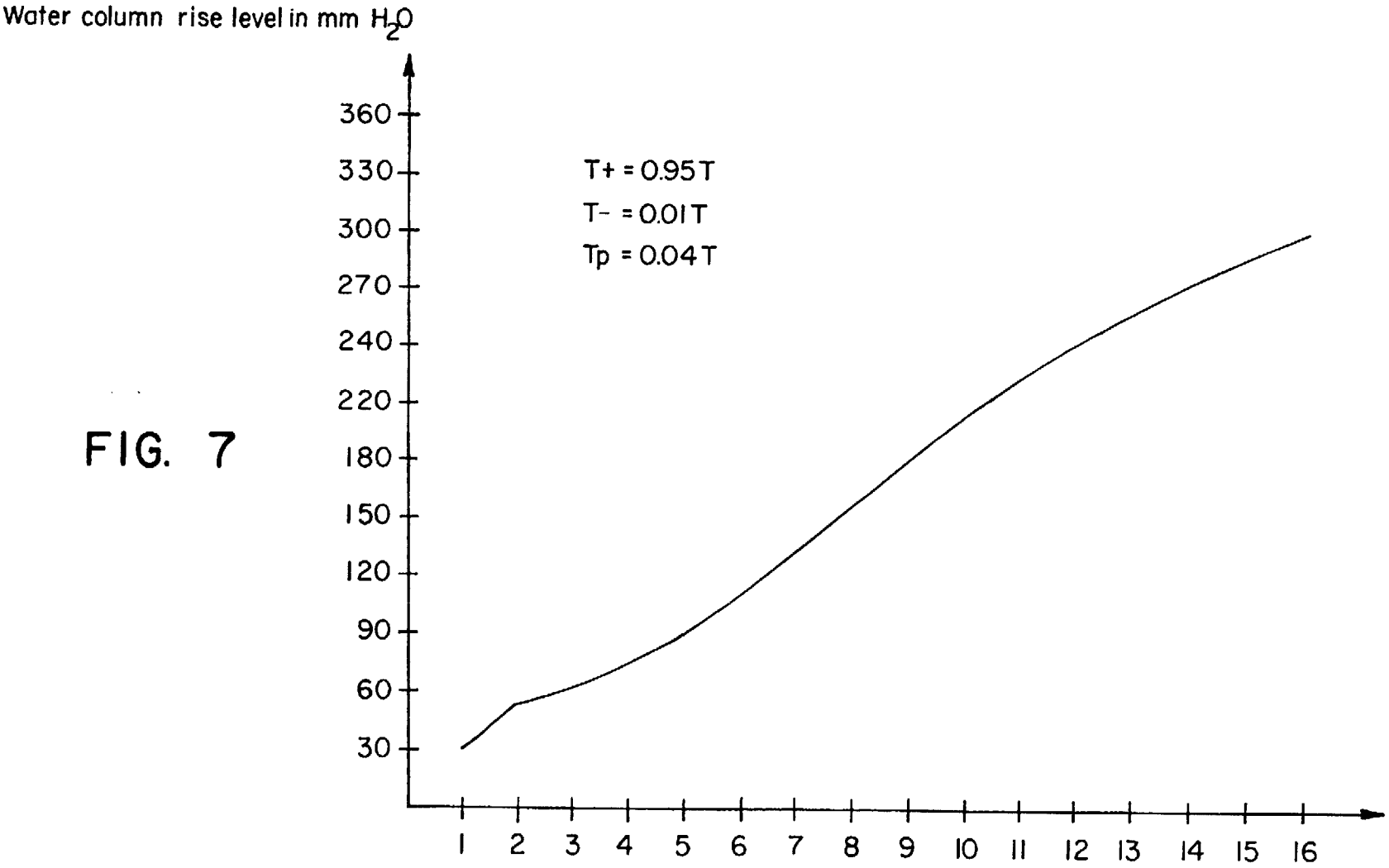
FIG. 7 is a diagram showing water column rise level in mm $H_2O$ relative to the number of days using the method with a typical, preferred pulse pattern, according to the invention.

Surprising and convincing results based on the present invention have established that when the following conditions are met $$0.8T<T+\leqq 0.98T;$$

$$0.0T<T-\leqq 0.05T;$$

$$0.02T<Tp\leqq 0.15T;$$

and $$3 \text{ seconds}<T\leqq 60 \text{ seconds}$$

and in particular when $$T+=0.95T;\ T-=0.01T;$$

and $$Tp=0.04T$$

then an extremely satisfactory dehydrating efficiency is obtainable. Long time laboratory testing with a pulse pattern according to the present invention relative to prior art pulse patterns have shown that the present invention provides a method which shows that even for a long term dehydration process, there is no tendency of a reverse action and in the test installation, the water column rise level was shown to rise steadily over a test period of 16 days. The rise level is related to water level outside the structure. However, in order to obtain a satisfactory dehydration result, the pulse pattern should suitably be continuously reiterated for a time period of at least 3 days. The diagram in FIG. 7 shows the typical dehydration tendency result for a pulse pattern with T+=0.95 T, T−=0.01T, and Tp=0.04T.

Contrary to the teachings of the prior art, the positive pulse may have a duration which is substantially greater than the duration of the negative pulse and even greater than the duration of the neutral period for pause Tp. Although the pulse pattern could provide positive and negative pulses of substantial equal numerical DC voltage values, there is nevertheless the possibility of providing a pulse pattern where said positive and negative pulses could have unequal numerical DC voltage values. Suitably, the positive pulse could have a DC voltage amplitude value elected from the range +12 volts to +250 volts, and the negative pulse could have a DC voltage amplitude elected from the range −12 volts to −250 volts.

Suitably, the total pulse period T should be greater than 3 seconds, but less or equal to 60 seconds. In a preferred embodiment, according to the invention, the total pulse period T is 6 seconds. However, it would be possible to set the duration of the total pulse period T to other values in the said range, while retaining the pulse duration ranges as indicated above.

I claim:

1. A method for dehydrating moist walls, floors, or a combination thereof, of a building structure of masonry or concrete through the principle of electro-osmosis, comprising the step of applying pulsating DC voltage of a specific pulse pattern to primary electrode means embedded in said structure, said primary electrode means forming anode means, and secondary electrode means embedded in the ground outside the structure and forming cathode means to be interactive with said anode means, said pulsating voltage having the pulse pattern having period T, comprised of a positive pulse of duration T+, a negative pulse of duration T−, and a neutral period or pause of duration Tp, wherein:

$$0.8T<T+\leqq 0.98T;$$

$$0.0T<T-\leqq 0.05T;$$

$$0.02T<Tp\leqq 0.15T;$$

and $$3 \text{ seconds}<T\leqq 60 \text{ seconds}$$

wherein the moist walls, floors or a combination thereof are dehydrated.

2. A method according to claim 1, wherein said pulse pattern has positive and negative pulses of equal numerical DC voltage values.

3. A method according to claim 1, wherein said pulse pattern has positive and negative pulses of unequal numerical DC voltage values.

4. A method according to claim 1, wherein the positive pulse has a DC voltage amplitude value elected from a range of +12 volts to +250 volts, and wherein the negative pulse has a DC voltage amplitude elected from a range of −12 volts to −250 volts.

5. A method according to claim 1, wherein $$T+=0.95T;\ T-=0.01T;$$

and $$Tp=0.04T.$$

6. A method according to claim 5, wherein said pulse pattern of duration T is reiterated for a time period of at least 3 days.

7. A method according to claim 5, wherein said time period is at least 15 days.

8. A method according to claim 1, wherein said pulse pattern of duration T is reiterated for a time period of at least 3 days.

9. A method according to claim 8, wherein said time period is at least 15 days.

* * * * *